US009289881B2

(12) United States Patent
Gosamo et al.

(10) Patent No.: US 9,289,881 B2
(45) **Date of Patent: *Mar. 22, 2016**

(54) ABRASIVE TOOLS HAVING A CONTINUOUS METAL PHASE FOR BONDING AN ABRASIVE COMPONENT TO A CARRIER

(71) Applicants: Saint-Gobain Abrasives, Inc., Worcester, MA (US); Saint-Gobain Abrasifs, Conflans-Sainte-Honorine (FR)

(72) Inventors: Ignazio Gosamo, Léglise-Thibessart (BE); Sebastien Marcel Robert Douveneau, Angevillers (FR)

(73) Assignees: SAINT-GOBAIN ABRASIVES, INC., Worcester, MA (US); SAINT-GOBAIN ABRASIFS (FR)

( * ) Notice: Subject to any disclaimer, the term of this patent is extended or adjusted under 35 U.S.C. 154(b) by 82 days.

This patent is subject to a terminal disclaimer.

(21) Appl. No.: 14/058,759

(22) Filed: Oct. 21, 2013

(65) Prior Publication Data

US 2014/0047777 A1 Feb. 20, 2014

Related U.S. Application Data

(63) Continuation of application No. 12/463,228, filed on May 8, 2009, now Pat. No. 8,568,205.

(60) Provisional application No. 61/087,430, filed on Aug. 8, 2008.

(51) Int. Cl.
*B24D 3/10* (2006.01)
*B24D 3/06* (2006.01)
(Continued)

(52) U.S. Cl.
CPC .. *B24D 3/10* (2013.01); *B24D 3/06* (2013.01); *B24D 3/18* (2013.01); *B24D 7/066* (2013.01);
(Continued)

(58) Field of Classification Search
CPC ..... B24D 3/10; B23D 7/06
USPC ..... 451/542, 544, 546–548; 51/296
See application file for complete search history.

(56) References Cited

U.S. PATENT DOCUMENTS 1,676,887 A 7/1928 Chamberlin
1,949,513 A 3/1934 Greenwood
(Continued)

FOREIGN PATENT DOCUMENTS

CN 87208852 U 12/1987
CN 1040535 A 3/1990
(Continued)

OTHER PUBLICATIONS

Norton, "Silencio" Clipper, 2009, pp. 26-27.
(Continued)

*Primary Examiner* — Dung Van Nguyen
(74) *Attorney, Agent, or Firm* — Abel Law Group, LLP; Joseph P. Sullivan

(57) ABSTRACT

An abrasive article includes a carrier element, an abrasive component, and a bonding region between the abrasive component and the carrier element. The abrasive component includes abrasive particles bound in a metal matrix. The abrasive component further includes a network of interconnected pores substantially filled with an infiltrant. The infiltrant has an infiltrant composition containing at least one metal element. The bonding region includes a bonding metal having a bonding metal composition containing at least one metal element. The bonding region is a region distinct from the carrier element and is a separate phase from the carrier element. An elemental weight percent difference is the absolute value of the difference in weight content of each element contained in the bonding metal composition relative to the infiltrant composition. The elemental weight percent difference between the bonding metal composition and the infiltrant composition does not exceed 20 weight percent.

20 Claims, 11 Drawing Sheets

Cold pressed diamond segment

(51) Int. Cl.
*B24D 3/18* (2006.01)
*B24D 7/06* (2006.01)

(52) U.S. Cl.
CPC .. *Y10T 428/12806* (2013.01); *Y10T 428/12847* (2013.01); *Y10T 428/12896* (2013.01); *Y10T 428/12903* (2013.01); *Y10T 428/12931* (2013.01); *Y10T 428/12986* (2013.01)

(56) References Cited

U.S. PATENT DOCUMENTS

| | | | |
|---|---|---|---|
| 1,954,330 | A | 4/1934 | Schurr |
| 3,088,251 | A | 5/1963 | Davis |
| 3,594,141 | A | 3/1967 | Houston et al. |
| 3,590,535 | A | 7/1971 | Benson et al. |
| 3,613,472 | A | 10/1971 | Held |
| 3,777,443 | A | 12/1973 | Shaw |
| 3,850,590 | A | 11/1974 | Chalkley et al. |
| 3,955,324 | A | 5/1976 | Lindstrom |
| 4,155,721 | A | 5/1979 | Fletcher |
| 4,208,154 | A | 6/1980 | Gundy |
| 4,224,380 | A | 9/1980 | Bovenkerk et al. |
| 4,397,555 | A | 8/1983 | Malcolm et al. |
| 4,453,484 | A | 6/1984 | Englund |
| 4,689,919 | A | 9/1987 | Kawakita et al. |
| 4,925,457 | A | 5/1990 | deKok et al. |
| 4,931,363 | A | 6/1990 | Slutz et al. |
| 4,977,710 | A | 12/1990 | Une |
| 5,000,273 | A | 3/1991 | Horton et al. |
| 5,049,165 | A | 9/1991 | Tselesin |
| 5,074,080 | A | 12/1991 | Erhardt et al. |
| 5,082,070 | A | 1/1992 | Obermeier et al. |
| 5,092,910 | A | 3/1992 | deKok et al. |
| 5,127,197 | A | 7/1992 | Brukvoort et al. |
| 5,127,923 | A | 7/1992 | Bunting et al. |
| 5,190,568 | A | 3/1993 | Tselesin |
| D342,270 | S | 12/1993 | Kwang |
| 5,380,390 | A | 1/1995 | Tselesin |
| 5,385,591 | A | 1/1995 | Ramanath et al. |
| 5,505,750 | A | 4/1996 | Andrews |
| 5,507,686 | A | 4/1996 | Wolters |
| 5,518,443 | A | 5/1996 | Fisher |
| 5,718,736 | A | 2/1998 | Onishi et al. |
| 5,791,330 | A | 8/1998 | Tselesin |
| 5,817,204 | A | 10/1998 | Tselesin |
| 5,865,571 | A | 2/1999 | Tankala et al. |
| 5,868,125 | A | 2/1999 | Maoujoud |
| 5,906,245 | A | 5/1999 | Tibbits et al. |
| 5,932,508 | A | 8/1999 | Armstrong et al. |
| 5,980,678 | A | 11/1999 | Tselesin |
| 6,009,962 | A | 1/2000 | Beaton |
| 6,024,635 | A | 2/2000 | Cruickshank et al. |
| 6,033,295 | A | 3/2000 | Fisher et al. |
| 6,039,641 | A | 3/2000 | Sung |
| 6,192,875 | B1 | 2/2001 | Koroku et al. |
| 6,193,770 | B1 | 2/2001 | Sung |
| 6,273,082 | B1 | 8/2001 | Tselesin |
| 6,286,498 | B1 | 9/2001 | Sung |
| D458,948 | S | 6/2002 | Chianese et al. |
| D459,375 | S | 6/2002 | Chianese et al. |
| D459,376 | S | 6/2002 | Chianese et al. |
| D459,740 | S | 7/2002 | Chianese et al. |
| 6,453,899 | B1 | 9/2002 | Tselesin |
| 6,458,471 | B2 | 10/2002 | Lovato et al. |
| 6,482,244 | B2 | 11/2002 | Tselesin |
| 6,485,533 | B1 | 11/2002 | Ishizaki et al. |
| 6,752,709 | B1 | 6/2004 | Skibo et al. |
| 6,755,729 | B2 | 6/2004 | Ramanath et al. |
| 6,817,936 | B1 | 11/2004 | Skeem et al. |
| 6,827,072 | B2 | 12/2004 | Schwammle |
| 6,872,133 | B2 | 3/2005 | Lee et al. |
| 6,878,051 | B2 | 4/2005 | Brach |
| 6,935,940 | B2 | 8/2005 | Skeem et al. |
| 7,210,474 | B2 | 5/2007 | Gaida et al. |
| 7,444,914 | B2 | 11/2008 | Brach |
| 7,879,129 | B2 | 2/2011 | Kosters et al. |
| 7,946,907 | B2 | 5/2011 | Heyen |
| 8,568,205 | B2 * | 10/2013 | Gosamo et al. ..... 451/547 |
| 8,591,295 | B2 | 11/2013 | Gosamo et al. |
| 2001/0023558 | A1 | 9/2001 | Tselesin |
| 2001/0025457 | A1 | 10/2001 | Tselesin |
| 2002/0129807 | A1 | 9/2002 | Cervantes |
| 2003/0213483 | A1 | 11/2003 | Sakarcan |
| 2003/0232586 | A1 | 12/2003 | Ramanath et al. |
| 2005/0235978 | A1 | 10/2005 | Kim et al. |
| 2005/0279533 | A1 | 12/2005 | Corica |
| 2006/0160476 | A1 | 7/2006 | Bright et al. |
| 2006/0185492 | A1 | 8/2006 | Chianese |
| 2007/0099548 | A1 | 5/2007 | Kumar et al. |
| 2008/0066969 | A1 | 3/2008 | Paul-Philippe |
| 2008/0076338 | A1 | 3/2008 | Andrews et al. |
| 2008/0153402 | A1 | 6/2008 | Arcona et al. |
| 2009/0199692 | A1 | 8/2009 | Heyen |
| 2009/0199693 | A1 | 8/2009 | Heyen |
| 2010/0035530 | A1 | 2/2010 | Gosamo et al. |
| 2010/0200304 | A1 | 8/2010 | Gosamo et al. |
| 2010/0248600 | A1 | 9/2010 | Chianese et al. |
| 2010/0279138 | A1 | 11/2010 | Zheng |
| 2011/0023911 | A1 | 2/2011 | Lenkeit et al. |

FOREIGN PATENT DOCUMENTS

| | | | |
|---|---|---|---|
| CN | 1239451 | A | 12/1999 |
| CN | 201295881 | Y | 8/2009 |
| DE | 19650718 | A1 | 6/1998 |
| EP | 0917939 | | 5/1999 |
| EP | 0925378 | B1 | 4/2002 |
| EP | 0871562 | B1 | 1/2003 |
| EP | 2075092 | A2 | 7/2009 |
| FR | 2532875 | A1 | 3/1984 |
| GB | 822058 | A | 10/1959 |
| GB | 2086822 | | 5/1982 |
| GB | 2086823 | | 5/1982 |
| GB | 2086824 | | 5/1982 |
| JP | 51121880 | A | 10/1976 |
| JP | S60178568 | U | 11/1985 |
| JP | 6268764 | A | 4/1987 |
| JP | 01-246077 | A | 10/1989 |
| JP | H02160475 | A | 6/1990 |
| JP | 03-060981 | A | 3/1991 |
| JP | 8066869 | A | 3/1996 |
| JP | 3034101 | A | 11/1996 |
| JP | H08323631 | A | 12/1996 |
| JP | 11-000915 | A | 1/1999 |
| JP | 2000061932 | A | 2/2000 |
| JP | 2001038718 | A | 2/2001 |
| JP | 2001527469 | A | 12/2001 |
| JP | 2002028856 | A | 1/2002 |
| JP | 2002079469 | A | 3/2002 |
| JP | 2002530212 | A | 9/2002 |
| JP | 2003011113 | A | 1/2003 |
| JP | 2003011115 | A | 1/2003 |
| JP | 3092359 | U | 3/2003 |
| JP | 2003103410 | A | 4/2003 |
| JP | 2004524170 | A | 8/2004 |
| JP | 200790565 | A | 4/2007 |
| JP | 2007136817 | A | 6/2007 |
| JP | 2007517675 | A | 7/2007 |
| JP | 2007216306 | A | 8/2007 |
| JP | 2009078055 | A | 4/2009 |
| JP | 2011530417 | A | 12/2011 |
| KR | 10-0263787 | B1 | 5/2000 |
| RU | 410955 | | 1/1974 |
| RU | 799956 | | 1/1981 |
| RU | 1175724 | | 8/1985 |
| SU | 844258 | A1 | 7/1981 |
| WO | 9810110 | A1 | 3/1998 |
| WO | 9824593 | A1 | 6/1998 |
| WO | 9857771 | A1 | 12/1998 |
| WO | 0030808 | A1 | 6/2000 |
| WO | 0245907 | A2 | 6/2002 |
| WO | 2006031044 | A1 | 3/2006 |
| WO | 2010016959 | A2 | 2/2010 |

(56) References Cited

FOREIGN PATENT DOCUMENTS

| | | | |
|---|---|---|---|
| WO | 2010097223 | A1 | 9/2010 |
| WO | 2010118440 | A2 | 10/2010 |
| WO | 2011029106 | A2 | 3/2011 |

OTHER PUBLICATIONS

Norton, "Silencio" Clipper, 2010, pp. 28-29.
Norton, Saint-Gobain, "Silencio" Clipper, 2011, pp. 28-29.
Norton, Saint-Gobain, "Silencio" Clipper, 2012, pp. 24-25.
Norton, Saint-Gobain Abrasives, "Technical and Sales Argumentation" 2008, 12 pages.
Norton, Saint-Gobain Abrasives S.A., "Silencio" EN13236, 2011, 2 pages.
Norton, Saint-Gobain Abrasives, "Silencio—Product Sheet", 2009, 1 page.
Hilti, "A breakthrough in speed", Hilti DD-B Series Core Bits, 2001, Hilti Corporation, http://hilti.com, 7 pages.
International Search Report for PCT/US2010/023807 dated Sep. 30, 2010, 7 pgs.
International Search Report for PCT/US2009/043356 dated Apr. 12, 2010, 8 pgs.
International Search Report for PCT/US2010/062633 dated Sep. 27, 2011, 6 pgs.
International Search Report for PCT/US2010/041858 dated Aug. 17, 2011, 10 pgs.
U.S. Appl. No. 12/703,407, filed Feb. 10, 2010, Inventors: Ignazio Gosamo et al.
U.S. Appl. No. 13/180,991, filed Jul. 12, 2011, Inventors: Ignazio Gosamo et al.
U.S. Appl. No. 12/983,075, filed Dec. 31, 2010, Inventors: Marc Linh Hoang et al.
Office Action dated Oct. 8, 2012 from Russian Application No. 2011137203, 3 pages.
Office Action dated Dec. 18, 2012 from Japanese Patent Application No. 2011-522075, 4 pages.
Beijing Factory 152, A new method of making diamond abrasive tools, Aug. 29, 1974, Non-metallic minerals, pp. 62-64, vol. 4.
Shi Xingkuan, et al., The Function of Wheel Infiltrant and the Its Suitable Selection, Tool Engineering, Sep. 22, 1995, pp. 23-26, vol. 29, Issue 9.

* cited by examiner

Cold pressed diamond segment

ABRASIVE TOOLS HAVING A CONTINUOUS METAL PHASE FOR BONDING AN ABRASIVE COMPONENT TO A CARRIER

CROSS-REFERENCE TO RELATED APPLICATION(S)

The present application is a continuation application of U.S. patent application Ser. No. 12/463,228, filed May 8, 2009 and entitled "Abrasive Tools Having a Continuous Metal Phase For Bonding An Abrasive Component To a Carrier," naming inventors Ignazio Gosamo and Sebastien Marcel Robert Douveneau, which claims priority to U.S. Provisional Patent Application No. 61/087,430, filed Aug. 8, 2008, entitled "Abrasive Tools Having a Continuous Metal Phase For Bonding An Abrasive Component To a Carrier," naming inventors Ignazio Gosamo and Sebastien Marcel Robert Douveneau, which applications are incorporated by reference herein in their entirety.

FIELD OF THE DISCLOSURE

The present invention generally relates to abrasive tools and processes for forming same. More specifically, the present invention relates to tools having a continuous metal phase for bonding an abrasive component to a carrier.

BACKGROUND

Infrastructure improvements, such as building additional roads and buildings, are vital to the continued economic expansion of developing regions. Additionally, developed regions have a continuing need to replacing aging infrastructure with new and expanded roads and buildings. As such, demand for construction remains high.

The construction industry utilizes a variety of tools for cutting and grinding of construction materials. Cutting and grinding tools are required for to remove or refinish old sections of roads. Additionally, quarrying and preparing finishing materials, such as stone slabs used for floors and building facades, require tools for drilling, cutting, and polishing. Typically, these tools include abrasive components bonded to a carrier element, such as a plate or a wheel. Breakage of the bond between the abrasive component and the carrier element can require replacing the abrasive component and/or the carrier element, resulting in down time and lost productivity. Additionally, the breakage can pose a safety hazard when portions of the abrasive component are ejected at high speed from the work area. As such, improved bonding between the abrasive component and the carrier element is desired.

SUMMARY

In an embodiment, an abrasive article can include a carrier element, an abrasive component, and a bonding region between the abrasive component and the carrier element. The abrasive component can include abrasive particles bound in a metal matrix. The abrasive component can include a network of interconnected pores substantially filled with an infiltrant having an infiltrant composition containing at least one metal element. The bonding region can comprise a bonding metal having a bonding metal composition containing at least one metal element. The bonding region can be a region distinct from the carrier element and can be a separate phase from the carrier element. An elemental weight percent difference can be the absolute value of the difference in weight content of each element contained in the bonding metal composition relative to the infiltrant composition. The elemental weight percent difference between the bonding metal composition and the infiltrant composition may not exceed 20 weight percent, such as by not exceeding 15 weight percent, for example by not exceeding 10 weight percent. In a particular embodiment, the elemental weight percent difference between the bonding metal composition and the infiltrant composition may not exceed 5 weight percent, such as by not exceeding 2 weight percent. In a further embodiment, the elemental weight percent difference between the bonding metal composition and the infiltrant composition is about 0 weight percent.

In an embodiment, an abrasive article can include a carrier element, an abrasive component, and a bonding region between the abrasive component and the carrier element. The abrasive component can include abrasive particles bound in a metal matrix. The metal matrix can include a network of interconnected pores substantially filled with bonding metal. The bonding region can be a region distinct from the carrier element and can be a separate phase from the carrier element. The bonding region can include the bonding metal. In a particular embodiment, the carrier element can have a tensile strength of at least about 600 N/mm$^2$.

In another embodiment, an abrasive article can include a carrier element, an abrasive component, and a bonding region between the abrasive component and the carrier element. The carrier element can have a tensile strength of at least about 600 N/mm$^2$. The abrasive component can include abrasive particles, a metal matrix, and an infiltrated bonding metal.

In a particular embodiment, the bonding region can include at least 90 wt % bonding metal. In another particular embodiment, the bonding region can consist essentially of bonding metal.

In a further embodiment, an abrasive article can include a carrier element, and abrasive component, and a bonding metal. The carrier element can be substantially compositionally stable at a process temperature. That is, the composition of the carrier element does not substantially change during a process in which the carrier element is heated to the process temperature. The abrasive component can include abrasive particles and a metal matrix. The abrasive component can include a network of interconnected pores and the metal matrix can be substantially compositionally stable at the process temperature. The bonding metal can be molten at the process temperature. At the process temperature, the bonding metal can infiltrate the network of interconnected pores and bond the abrasive component to the carrier element. In a particular embodiment, the process temperature can be in a range of between about 900° C. and about 1200° C.

In a particular embodiment, the abrasive article can have a destructive bend strength of at least about 500 N/mm$^2$, such as at least about 600 N/mm$^2$, for example at least about 700 N/mm$^2$. In a further particular embodiment, the abrasive article can be a grinding ring section having a destructive bend strength of at least about 500 N/mm$^2$, such as at least about 600 N/mm$^2$, for example at least about 700 N/mm$^2$. In another particular embodiment, the abrasive article can be a core bit having a destructive bend strength of at least about 750 N/mm$^2$, such as at least about 775 N/mm$^2$, for example at least about 800 N/mm$^2$. In yet another particular embodiment, the abrasive article can be a cutting-off blade having a destructive bend strength of at least about 1400 N/mm$^2$, such as at least about 1600 N/mm$^2$, for example at least about 1800 N/mm$^2$.

In a further particular embodiment, the bonding metal composition can include a metal selected from the group consisting of copper, a copper-tin bronze, a copper-tin-zinc alloy, and any combination thereof. In an example, the copper-tin bronze can include a tin content not greater than about 20%. In another example, the copper-tin-zinc alloy can include a tin content not greater than about 20% and a zinc content not greater than about 10%. In yet another example, the bonding metal composition can further include titanium, silver, manganese, phosphorus, aluminum, magnesium, or any combination thereof.

In another particular embodiment, the abrasive particles can include superabrasive particles, such as diamond. In an example, the abrasive particles can be in an amount between about 2.0 vol % and 50 vol % of the abrasive component.

In yet another particular embodiment, the metal matrix can include a metal selected from the group consisting of iron, iron alloy, tungsten, cobalt, nickel, chromium, titanium, silver, and any combination thereof. In an example, the metal matrix can further include a rare earth element. The rare earth element can be in an amount not greater than about 3.0 wt %. In another example, the metal matrix can further include a wear resistant component, such as tungsten-carbide.

In a further particular embodiment, the abrasive component can have a porosity of between about 25% and 50%. In an example, the bonding metal can substantially fill the network of interconnected voids to form a densified abrasive component having a density of at least about 96% dense. In another example, an amount of bonding metal within the densified abrasive component can be between about 20 wt % and about 45 wt % of the densified abrasive component.

In yet another embodiment, a method of forming an abrasive article can include forming an abrasive component by compressing a mixture. The mixture can include abrasive particles and metal matrix, and the abrasive component can have an interconnected network of pores. The method further can include arranging a bonding metal between the abrasive component and a carrier element and heating to liquefy the bonding metal. The method still further can include flowing at least a portion of the bonding metal into the interconnected network of pores to form a densified abrasive component, and cooling thereby bonding the densified abrasive component to the carrier element. In a particular embodiment, forming can include cold pressing the mixture. In an example, the cold pressing can be carried out at a pressure of between about 50 $kN/cm^2$ (500 MPa) and about 250 $kN/cm^2$ (2500 MPa). In another particular embodiment, flowing occurs by capillary action.

In yet another particular embodiment, heating can include heating to a process temperature, the process temperature can be above the melting point of the bonding metal, below a melting point of the carrier element, and below a melting point of the porous abrasive component. In an example, the process temperature can be in a range of between about 900° C. and about 1200° C. In another example, the heating can be carried out in a reducing atmosphere. In yet another example, the heating can be carried out in a furnace, such as a tunnel furnace or a batch furnace.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

Figure 1:
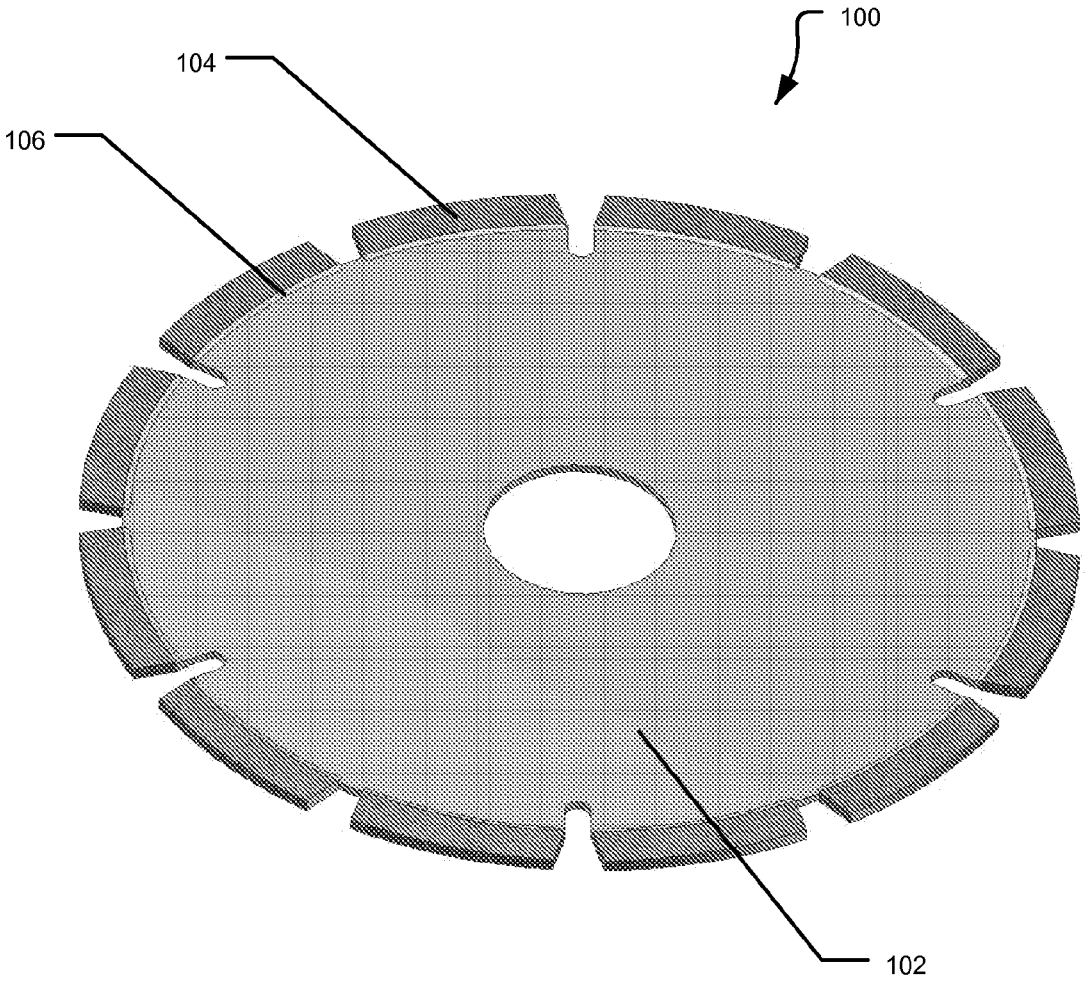
FIGS. 1 through 3 are illustrations of exemplary abrasive tools.

According to an embodiment, the abrasive tool includes a carrier element and an abrasive component. The abrasive tool can be a cutting tool for cutting construction materials, such as a saw for cutting concrete. Alternatively, the abrasive tool can be a grinding tool such as for grinding concrete or fired clay or removing asphalt. The carrier element can be a solid metal disk, a ring, a ring section, or a plate. The abrasive component can include abrasive particles embedded in a metal matrix. The metal matrix can have a network of interconnected pores or pores that are partially or substantially fully filled with an infiltrant. A bonding region can be between the carrier element and the abrasive component and can contain a bonding metal. The bonding metal in the bonding region can be continuous with the infiltrant filling the network of interconnected pores.

In an exemplary embodiment, an abrasive component includes abrasive particles embedded in a metal matrix having a network of interconnected pores. The abrasive particles can be a superabrasive such as diamond or cubic boron nitride. The abrasive particles can have a particle size of not less than about 400 US mesh, such as not less than about 100 US mesh, such as between about 25 and 80 US mesh. Depending on the application, the size can be between about 30 and 60 US mesh. The abrasive particles can be present in an amount between about 2 vol % to about 50 vol %. Additionally, the amount of abrasive particles may depend on the application. For example, an abrasive component for a grinding or polishing tool can include between about 3.75 and about 50 vol % abrasive particles. Alternatively, an abrasive component for a cutting-off tool can include between about 2 vol % and 6.25 vol % abrasive particles. Further, an abrasive component for core drilling can include between about 6.25 vol % and 20 vol % abrasive particles.

The metal matrix can include iron, iron alloy, tungsten, cobalt, nickel, chromium, titanium, silver, and any combination thereof. In an example, the metal matrix can include a rare earth element such as cerium, lanthanum, and neodymium. In another example, the metal matrix can include a wear resistant component such as tungsten carbide. The metal matrix can include particles of individual components or pre-alloyed particles. The particles can be between about 1.0 microns and about 250 microns.

In an exemplary embodiment, the bonding metal composition can include copper, a copper-tin bronze, a copper-tin-zinc alloy, or any combination thereof. The copper-tin bronze may include a tin content not greater than about 20 wt %, such as not greater than about 15 wt %. Similarly, the copper-tin-zinc alloy may include a tin content not greater than about 20 wt %, such as not greater than about 15 wt %, and a zinc content not greater than about 10 wt %.

According to embodiments herein, the bonding region can form an identifiable interfacial layer that has a distinct phase from both the underlying carrier and the abrasive component. The bonding metal composition is related to the infiltrant composition in having a certain degree of commonality of elemental species. Quantitatively, an elemental weight percent difference between the bonding metal composition and the infiltrant composition does not exceed 20 weight percent. Elemental weight percent difference is defined as the absolute value of the difference in weight content of each element contained in the bonding metal composition relative to the infiltrant composition.

By way of example only, in an embodiment having a (i) bonding metal composition containing 85 weight percent Cu, 10 weight percent Sn and 5 weight percent Zn, and (ii) an infiltrant composition containing 82 weight percent Cu, 17 weight percent Sn, and 1 weight percent Zn, the elemental weight percent difference between the bonding metal composition and the infiltrant composition for Cu is 5 weight percent, for Sn is 7 weight percent and for Zn is 4 weight percent. The maximum elemental weight percent difference between the bonding metal composition and the infiltrant composition is, accordingly, 7 weight percent.

Other embodiments have closer compositional relationships between the bonding metal composition and the composition of the infiltrant. The elemental weight percent difference between the bonding metal composition and the infiltrant composition may, for example, not exceed 15 weight percent, 10 weight percent, 5 weight percent, or may not exceed 2 weight percent. An elemental weight percent difference of about zero represents the same composition making up the bonding region and the infiltrant. The foregoing elemental values may be measured by any suitable analytical means, including microprobe elemental analysis, and ignores alloying that might take place along areas in which the infiltrant contacts the metal matrix.

Turning to the details of the process by which the abrasive component may be manufactured, abrasive particles can be combined with a metal matrix to form a mixture. The metal matrix can include iron, iron alloy, tungsten, cobalt, nickel, chromium, titanium, silver, or any combination thereof. In an embodiment, the metal matrix can include a rare earth element, such as cerium, lanthanum, and neodymium. In another embodiment, the metal matrix can include a wear resistant component, such as tungsten carbide. The metal matrix can include metal particles of between about 1 micron and 250 microns. The metal matrix can include a blend of particles of the components of the metal matrix or can be pre-alloyed particles of the metal matrix. Depending on the application, the composition of the metal matrix may vary.

In an embodiment, the metal matrix can conform to the formula $(WC)_w W_x Fe_y Cr_z X_{(1-w-x-y-z)}$, wherein $0 \le w \le 0.8$, $0 \le x \le 0.7$, $0 \le y \le 0.8$, $0 \le z \le 0.05$, $w+x+y+z \le 1$, and X can include other metals such as cobalt and nickel.

In another embodiment, the metal matrix can conform to the formula $(WC)_w W_x Fe_y Cr_z Ag_v X_{(1-v-w-x-y-z)}$, wherein $0 \le w \le 0.5$, $0 \le x \le 0.4$, $0 \le y \le 1.0$, $0 \le z \le 0.05$, $0 \le v \le 0.1$, $v+w+x+y+z \le 1$, and X can include other metals such as cobalt and nickel.

The abrasive particles can be a superabrasive, such as diamond, cubic boron nitride (CBN), or any combination thereof. The abrasive particles can be present in an amount between about 2 vol % to about 50 vol %. Additionally, the amount of abrasive particles may depend on the application. For example, an abrasive component for a grinding or polishing tool can include between about 3.75 and about 50 vol % abrasive particles. Alternatively, an abrasive component for a cutting tool can include between about 2 vol % and 6.25 vol % abrasive particles. Further, an abrasive component for core drilling can include between about 6.25 vol % and 20 vol % abrasive particles. The abrasive particles can have a particle size of less than about 400 US mesh, such as not less than about 100 US mesh, such as between about 25 and 80 US mesh. Depending on the application, the size can be between about 30 and 60 US mesh.

The mixture of metal matrix and abrasive particles can be pressed, such as by cold pressing, to form a porous abrasive component. For example, the cold pressing can be carried out at a pressure of between about 50 kN/cm$^2$ (500 MPa) to about 250 kN/cm$^2$ (2500 MPa). The resulting porous abrasive component can have a network of interconnected pores. In an example, the porous abrasive component can have a porosity between about 25 and 50 vol %.

In an embodiment, a tool preform can be assembled by stacking a carrier element, a bonding slug, and the abrasive component. The carrier element can be in the form of a ring, a ring section, a plate, or a disc. The carrier element can include heat treatable steel alloys, such as 25CrMo4, 75Cr1, C60, or similar steel alloys for carrier elements with thin cross sections or simple construction steel like St 60 or similar for thick carrier elements. The carrier element can have a tensile strength of at least about 600 N/mm$^2$. The carrier element can be formed by a variety of metallurgical techniques known in the art.

The bonding slug can include a bonding metal having a bonding metal composition. The bonding metal composition can include copper, a copper-tin bronze, a copper-tin-zinc alloy, or any combination thereof. The bonding metal composition can further include titanium, silver, manganese, phosphorus, aluminum, magnesium, or any combination thereof. For example, the bonding metal can have a melting point between about 900° C. and about 1200° C.

In an embodiment, the bonding slug can be formed by cold pressing a powder of the bonding metal. The powder can include particles of individual components or pre-alloyed particles. The particles can have a size of not greater than about 100 microns. Alternatively, the bonding slug may be formed by other metallurgical techniques known in the art.

The tool preform can be heated to a temperature above the melting point of the bonding metal but below the melting point of the metal matrix and the carrier element. For example, the temperature can be between about 900° C. and about 1200° C. The tool preform can be heated in a reducing atmosphere. Typically, the reducing atmosphere can contain an amount of hydrogen to react with oxygen. The heating can be carried out in a furnace, such as a batch furnace or a tunnel furnace.

In an embodiment, as the bonding metal melts, the liquid bonding metal is drawn into the network of interconnected pores of the abrasive component, such as through capillary action. The bonding metal can infiltrate and substantially fill the network of interconnected pores. The resulting densified abrasive component can be not less than about 96% dense. The amount of bonding metal that infiltrates the abrasive component can be between about 20 wt % and 45 wt % of the densified abrasive component. A portion of the bonding metal may remain between the abrasive component and the carrier element such that a bonding region consisting essentially of the bonding metal is formed between the carrier element and the abrasive component. The bonding region can be an identifiable region distinct from the carrier element and the abrasive component. The bonding region can include at least about 90 wt % bonding metal, such as at least about 95 wt % bonding metal, such as at least about 98 wt % bonding metal. The bonding metal can be continuous throughout the bonding region and the densified abrasive component.

FIG. 1 illustrates a cutting disk 100. The cutting disk 100 includes a disk-shaped carrier element 102 and a plurality of abrasive components 104 attached to the carrier element 102. A bonding region 106 can be between the carrier element 102 and the abrasive components 104.

Figure 2:
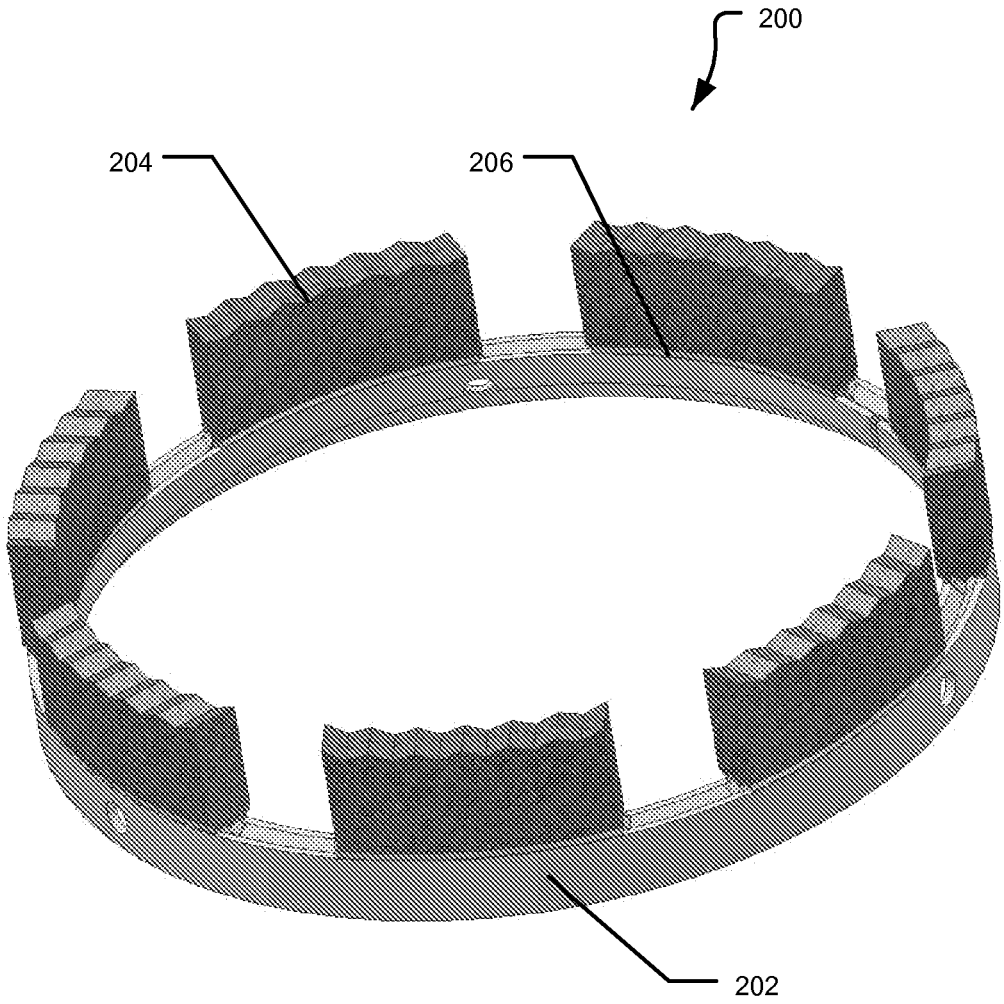

FIG. 2 illustrates a core-drilling tool 200. The core-drilling tool includes a ring-shaped carrier element 202 and a plurality of abrasive components 204 attached to the carrier element 202. A bonding region 206 can be between the carrier element 202 and the abrasive components 204.

Figure 3:
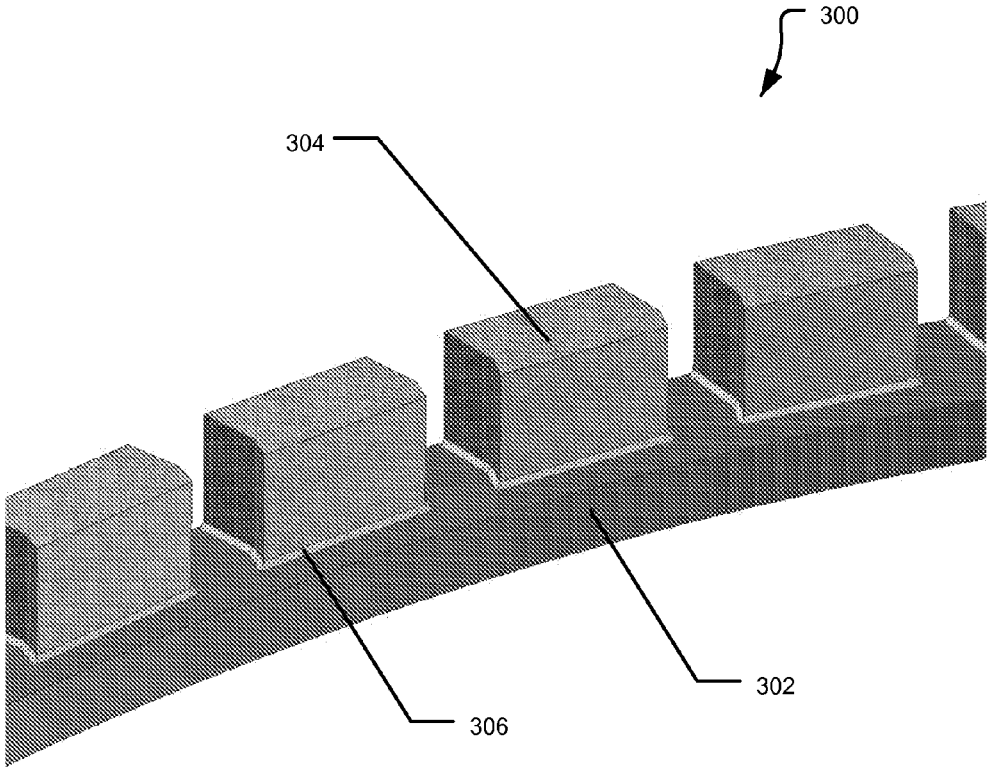

FIG. 3 illustrates a grinding ring section 300. The tool includes a ring section-shaped carrier element 302 that can be attached, such as by bolting to a support ring and a plurality of abrasive components 304 attached to the carrier element 302. A bonding region 306 can be between the carrier element 302 and the abrasive components 304.

Figure 4:
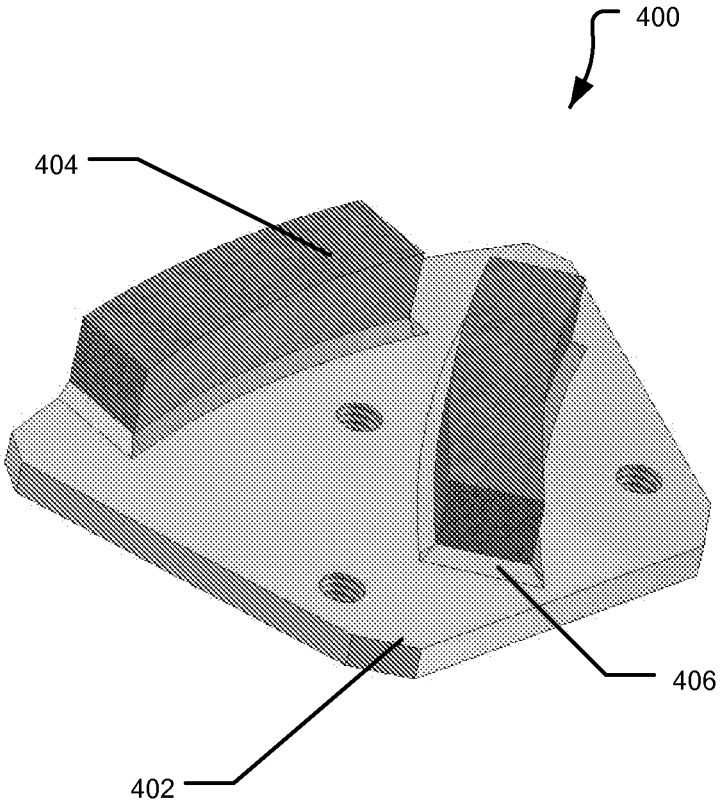
FIG. 4 is an illustration of an abrasive-containing segment for mounting on a tool.

FIG. 4 illustrates an abrasive-containing segment 400. The abrasive containing segment can be attached, such as by bolting, to a tool. The abrasive-containing segment includes a carrier element 402 and a plurality of abrasive components 404 attached to the carrier element 402. A bonding region 406 can be between the carrier element 402 and the abrasive components 404.

Figure 5:
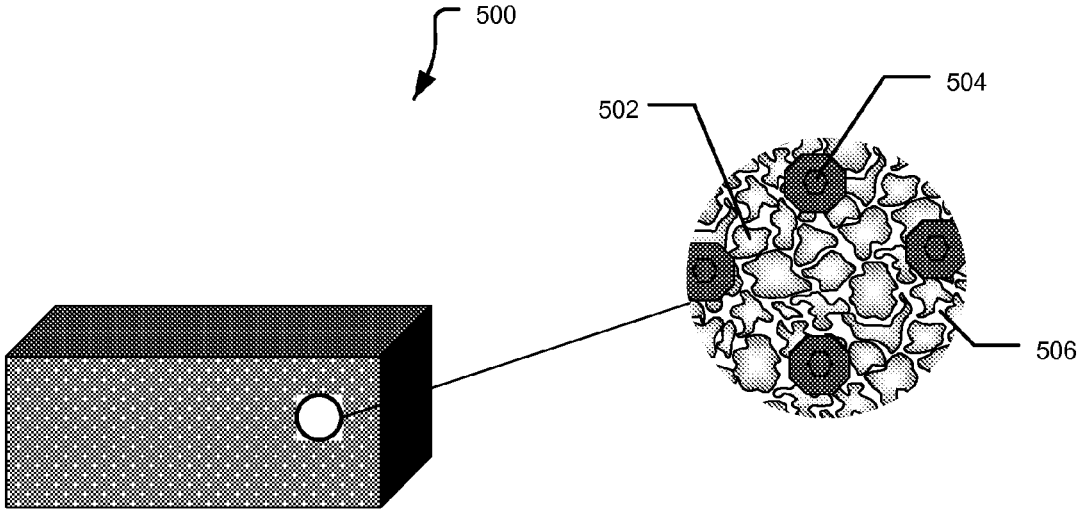
FIG. 5 is a schematic diagram illustrating an abrasive segment prior to bonding.

FIG. 5 illustrates an exemplary abrasive component 500. The abrasive component includes metal matrix particles 502 and abrasive particles 504. Between the metal matrix particles 502, the abrasive component 500 includes a network of interconnected pores 506.

Figure 6:
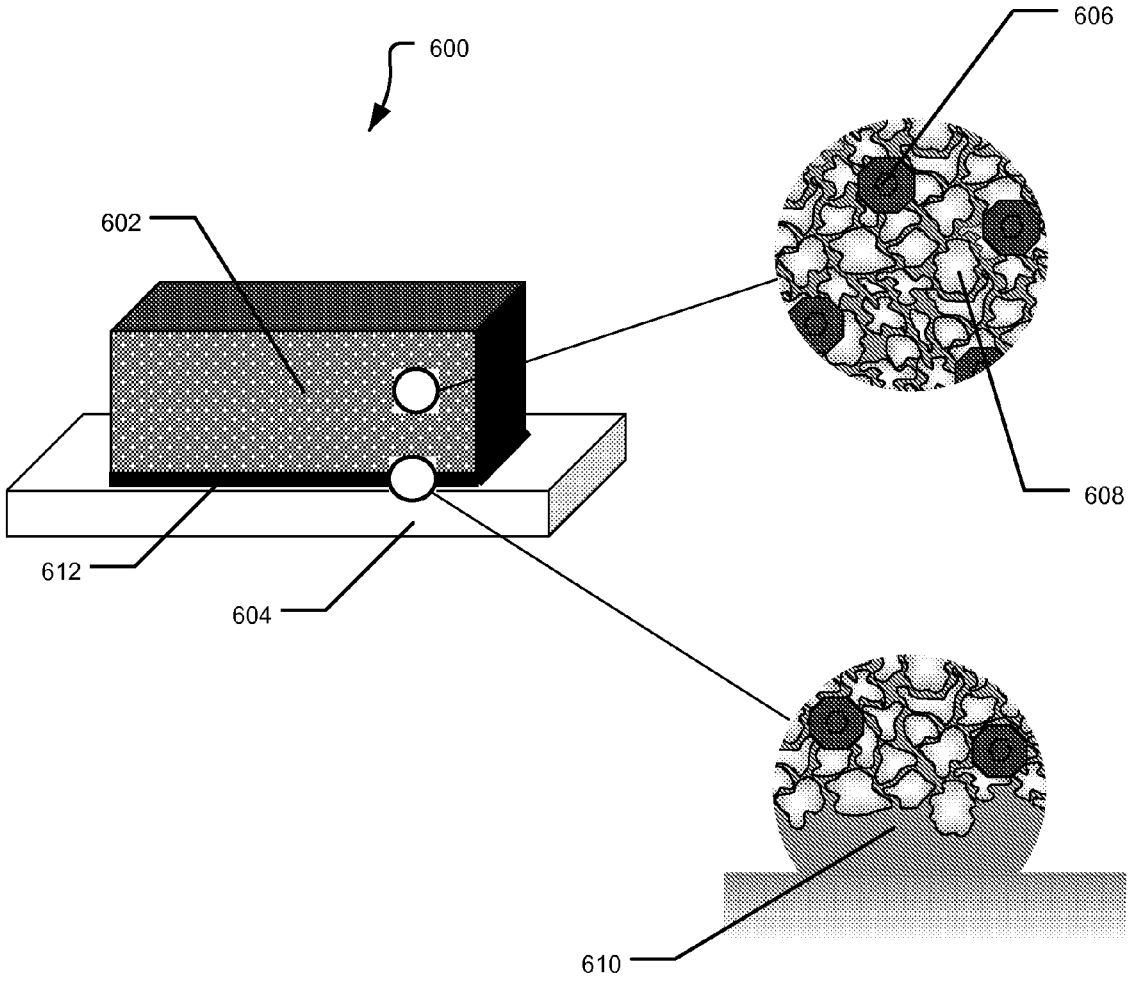
FIG. 6 is a schematic diagram illustrating an abrasive segment bonded to a carrier.

FIG. 6 illustrates an exemplary abrasive tool 600. The abrasive tool 600 includes a densified abrasive component 602 bonded to a carrier element 604. The densified abrasive component includes metal matrix particles 606 and abrasive particles 608. In the densified abrasive component 602, bonding metal 610 has infiltrated the network of interconnected pores and filled the space between the metal matrix particles 606. Additionally, the tool 600 includes a bonding zone 612 consisting essentially of bonding metal 614. The bonding metal 614 of the bonding zone 612 is continuous with the bonding metal 610 of the densified abrasive component 602.

EXAMPLES

Example 1

Figure 7:
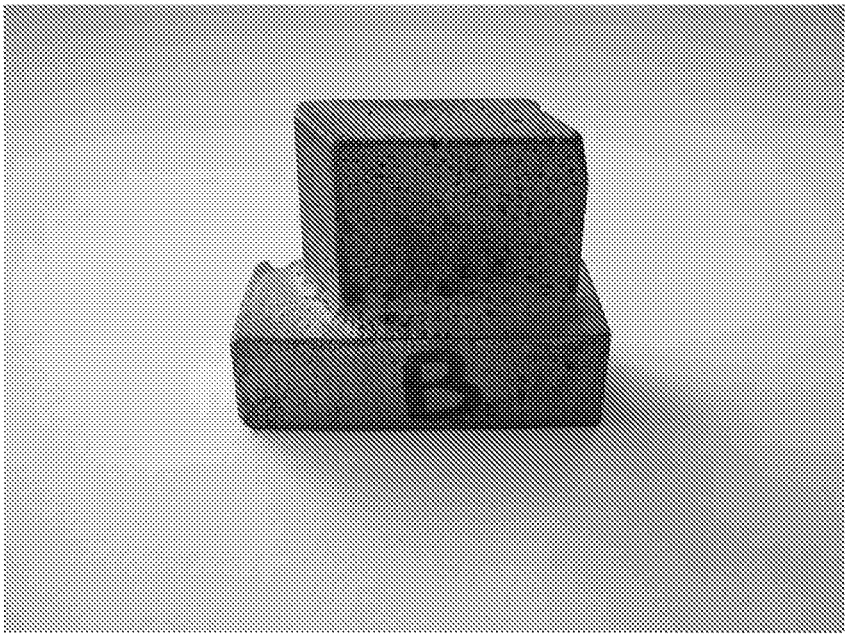
FIG. 7 is a photograph of carrier ring section prepared by braze fitting.

For example, Sample 1, a grinding ring section is prepared as follows. A standard abrasive component is braze fitted to a carrier ring section. The standard abrasive component is formed by cold pressing of a mixture of 2.13 wt % diamond abrasive particles and 67.3 wt % metal composition. The diamond abrasive particles are ISD 1600 having a particle size between 30 US mesh and 50 US mesh. The metal composition includes 40.0 wt % tungsten carbide, 59.0 wt % tungsten metal, and 1.0 wt % chromium. The abrasive component is infiltrated with a copper based infiltrant. The fully densified infiltrated abrasive component is then braze fitted to a carrier ring section using a Degussa 4900 brazing alloy. Sample 1 is shown in FIG. 7.

Figure 8:
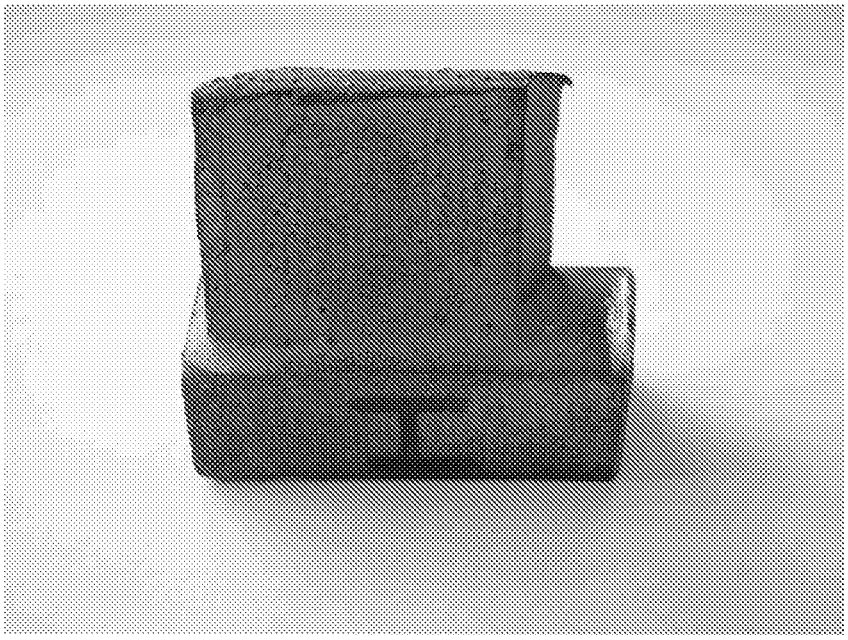
FIG. 8 is a photograph of carrier ring section prepared by infiltration bonding.

Sample 2 is prepared by infiltration bonding of an abrasive component to a carrier ring section. The abrasive component is formed by cold pressing of a mixture of 2.13 wt % diamond abrasive particles and 67.3 wt % metal composition. The diamond abrasive particles are ISD 1600 having a particle size between 30 US mesh and 50 US mesh. The metal composition includes 40 wt % tungsten carbide, 59 wt % tungsten metal, and 1 wt % chromium. The abrasive component, the carrier ring, and a bonding metal slug are placed in a furnace to melt the bonding metal. The copper based bonding metal infiltrates the abrasive component forming a densified abrasive component bonded to the carrier ring section. Sample 2 is shown in FIG. 8.

Destructive bend strengths are determined for Sample 1 and Sample 2 by measuring a torque required to remove the abrasive component from the carrier ring section. The destructive bend test is carried out using the test procedure defined in section 6.2.4.2 of the European standard EN 13236:2001, Safety requirements for superabrasives. The destructive bend strength of Sample 1 is 350 $N/mm^2$. The destructive bend strength of Sample 2 is greater than 600 $N/mm^2$.

Figure 13:
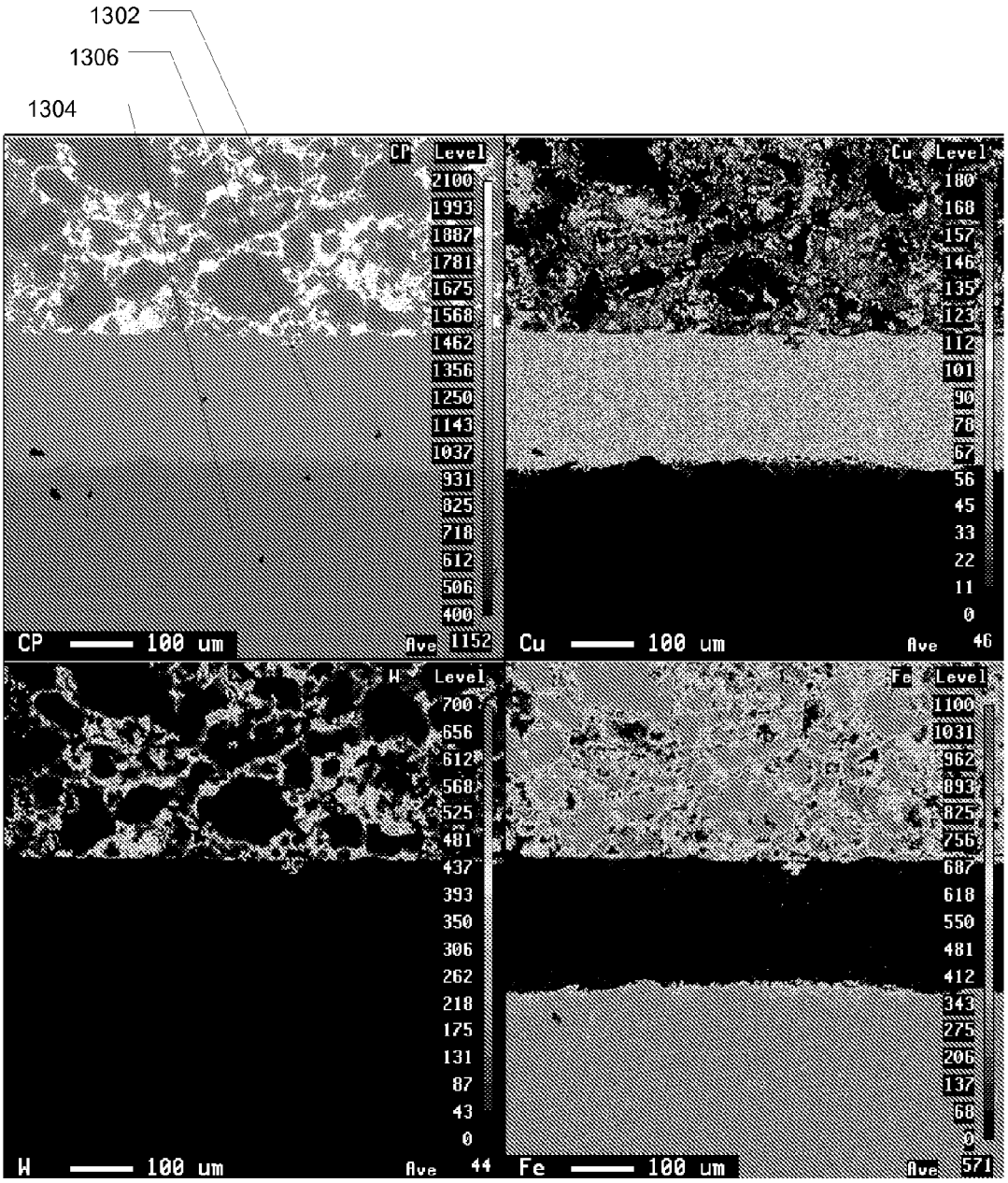
FIGS. 13 and 14 are elemental mappings of a carrier ring section.
Figure 14:
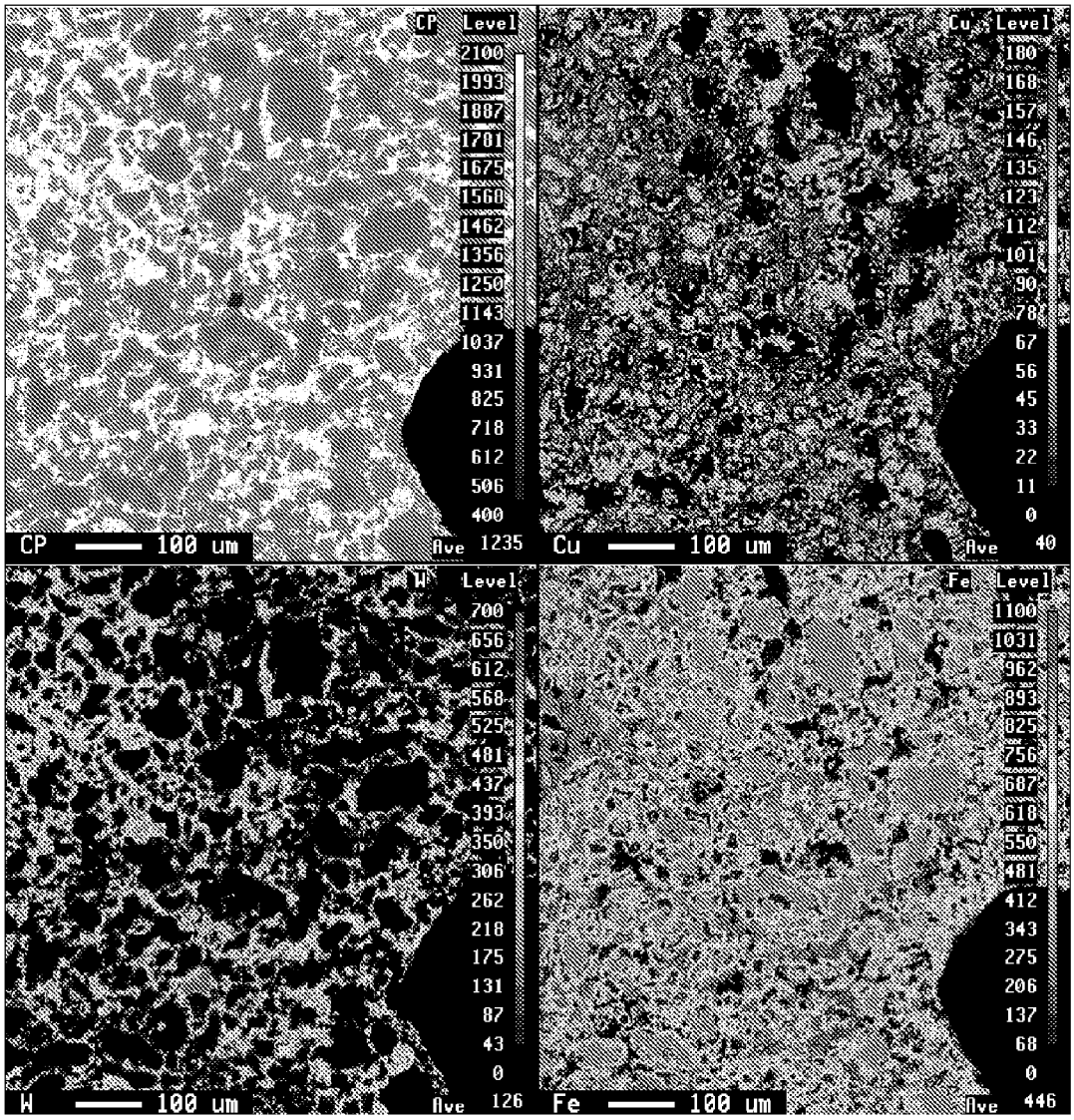

Additionally, elemental mapping is performed on Sample 2. Cross-sections of the bonding region and the infiltrated abrasive component are polished and subjected to elemental mapping by scanning electron microscope (SEM). The amount of Fe, Cu, and W is mapped in each region. FIG. 13 shows the elemental mapping of the bonding region. Abrasive component 1302 is bonded to carrier 1304 by a Cu bonding layer 1306. FIG. 14 shows the elemental mapping of the abrasive component. The elemental mapping demonstrates that the composition of the infiltrant within the abrasive component is primarily Cu with about 2 wt % Fe.

Example 2

For example, Sample 3 is a cutting-off blade prepared by direct sintering an abrasive component to a steel carrier element. The abrasive component includes 1.25 wt % diamond abrasive particles, 59.3 wt % copper, 6.6 wt % Sn, 3.6 wt % nickel, and 29.2 wt % iron. The diamond abrasive particles are SDB45+having a particle size in the range of 40 US mesh and 60 US mesh.

Sample 4 is a cutting-off blade prepared by laser welding an abrasive component to a steel carrier element. The abrasive component includes 1.25 wt % diamond abrasive particles, 44.0 wt % copper, 38.1 wt % iron, 7.9 wt % tin, 6.0 wt % brass, 2.8 wt % of a diamond free backing. The diamond abrasive particles are SDB45+ having a particle size in the range of 40 US mesh and 60 US mesh. The diamond free backing includes 47.9 wt % bronze, 13.0 wt % nickel, and 39.0 wt % iron.

Figure 9:
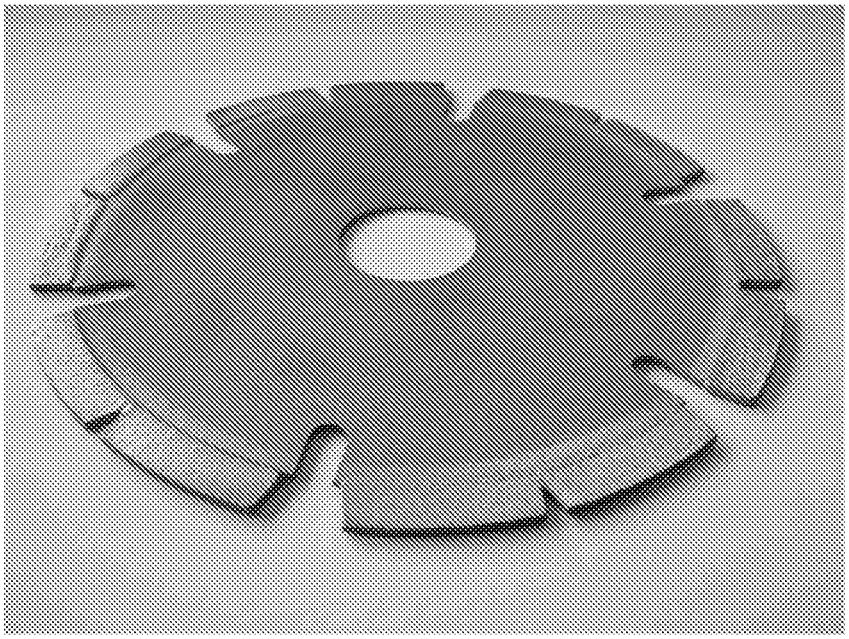
FIG. 9 is a photograph of cutting off blade prepared by infiltration bonding.

Sample 5 is a cutting-off blade prepared by infiltration bonding an abrasive component to a steel carrier element. The abrasive component is formed by cold pressing of a mixture of 1.25 wt % diamond abrasive particles and 74.4 wt % metal composition. The diamond abrasive particles are SDB45+ having a particle size in the range of 40 US mesh and 60 US mesh. The metal composition includes 80.0 wt % iron, 7.5 wt % nickel, and 12.5 wt % bronze. The abrasive component, the carrier ring, and a bonding metal slug are placed in a furnace to melt the bonding metal. The copper based bonding metal infiltrates the abrasive component forming a densified abrasive component bonded to the carrier disc. Sample 5 is shown in FIG. 9.

Destructive bend strength is determined by measuring the torque required to remove the abrasive component from the steel carrier element. The test is repeated a number of times for each of Sample 3-5, as shown in Table 1. The destructive bend strength test is carried out using the test principles defined in section 6.2.4.2 of the European standard EN13236: 2001, Safety requirements for superabrasives.

TABLE 1

| Destructive Bend Strength (Range - N/mm2) | Direct Sintered (Number) | Laser Welded (Number) | Infiltration Bonded (Number) |
|---|---|---|---|
| 800-1000 | 8 | 0 | 0 |
| 1001-1200 | 0 | 0 | 0 |
| 1201-1400 | 0 | 2 | 0 |
| 1401-1600 | 0 | 7 | 2 |
| 1601-1800 | 0 | 0 | 4 |
| 1801-2000 | 0 | 0 | 1 |
| 2001-2200 | 0 | 0 | 5 |

Example 3

Figure 10:
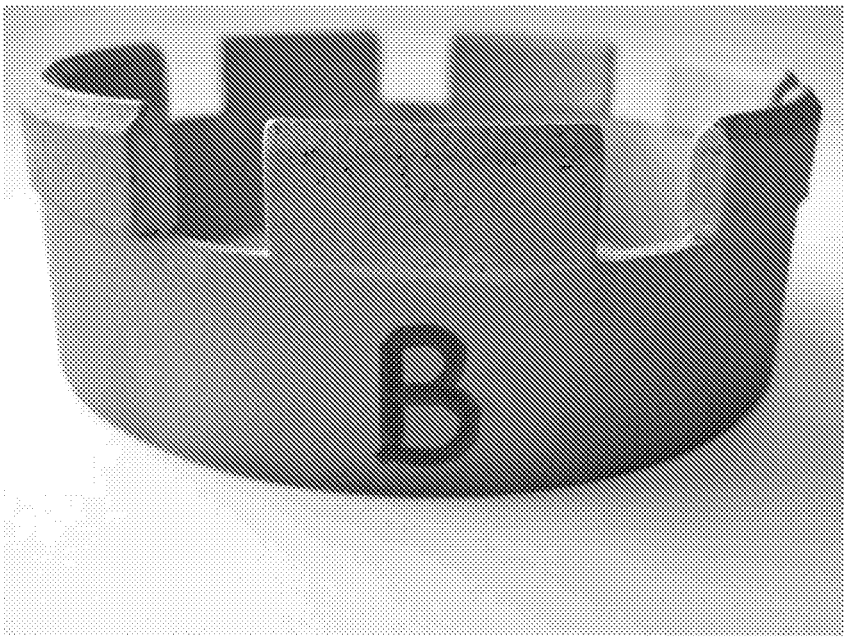
FIG. 10 is a photograph of a core bit prepared by braze fitting.

Sample 6 is a core bit prepared by brazing a sintered abrasive component to a carrier ring. The abrasive component includes 2.43 wt % diamond abrasive particles, 32.7 wt % iron, 5.4 wt % silver, 2 wt % copper, 57.5 wt % cobalt, and a diamond free iron based backing. The diamond abrasive particles are is ISD 1700 having a particle size between about 40 US mesh and 50 US mesh. Sample 6 is shown in FIG. 10.

Figure 11:
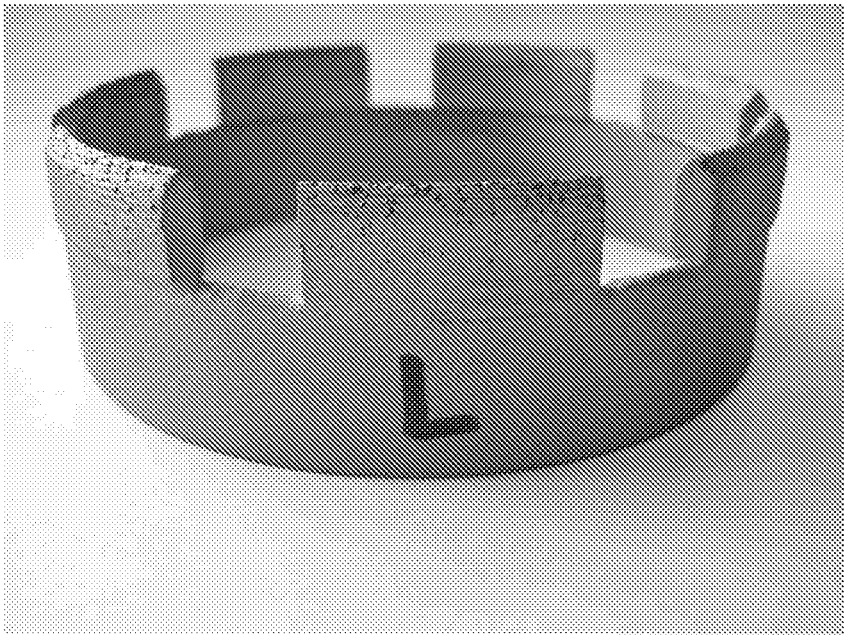
FIG. 11 is a photograph of a core bit prepared by laser welding.

Sample 7 is a core bit prepared by laser welding a sintered abrasive component to a carrier ring. The abrasive component includes 2.43 wt % diamond abrasive particles, 32.7 wt % iron, 5.4 wt % silver, 2 wt % copper, 57.5 wt % cobalt, and a diamond free iron based backing. The diamond abrasive particles are is ISD 1700 having a particle size between about 40 US mesh and 50 US mesh. Sample 7 is shown in FIG. 11.

Figure 12:
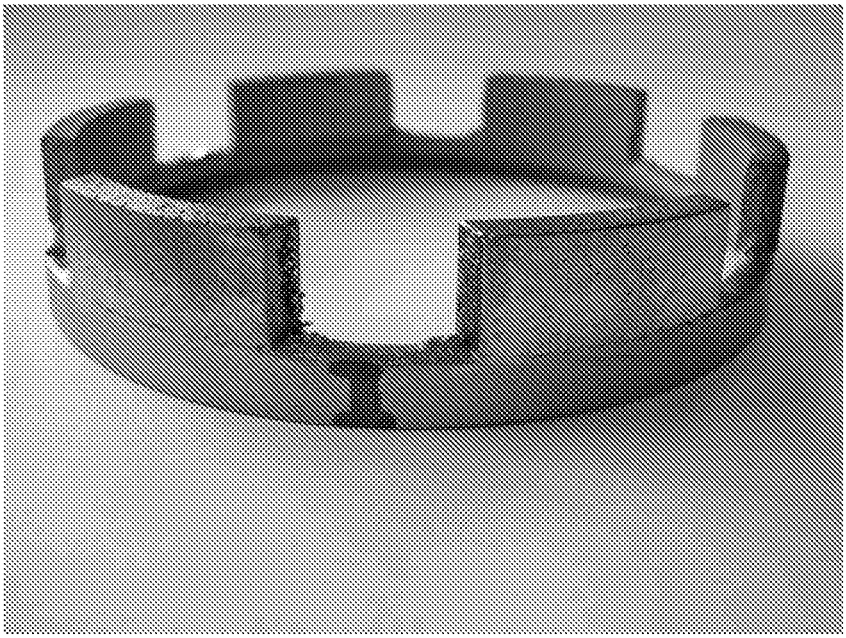
FIG. 12 is a photograph of a core bit prepared by infiltration bonding.

Sample 8 is a core bit prepared by infiltration bonding an abrasive component to a carrier ring. The abrasive component is formed by cold pressing of a mixture of 2.43 wt % diamond abrasive particles and 60.7 wt % metal composition. The metal composition includes 99.0 wt % tungsten and 1.0 wt % chromium. The abrasive component, the carrier ring, and a bonding metal slug are placed in a furnace to melt the bonding metal. The bonding metal infiltrates the abrasive component forming a densified abrasive component bonded to the carrier ring. Sample 8 is shown in FIG. 12.

Destructive bend strength is determined by measuring the torque required to remove the abrasive component from the carrier ring. The test is repeated a number of times for each of Sample 6-8, as shown in Table 2. The destructive bend strength test is carried out using the test principles defined in section 6.2.4.2 of the European standard EN 13236:2001, Safety requirements for superabrasives.

TABLE 2

| Segment Number | Sample 6 Destructive Bend Strength N/mm$^2$ | Sample 7 Destructive Bend Strength N/mm$^2$ | Sample 8 Destructive Bend Strength N/mm$^2$ |
|---|---|---|---|
| 1 | 542 | 733 | 806 |
| 2 | 542 | 733 | 806 |
| 3 | 542 | 670 | 989 |
| 4 | 542 | 765 | 806 |
| 5 | 542 | 702 | 702 |
| 6 | 542 | 765 | 963 |
| Avg | 542 | 728 | 845 |

Table 3 shows a comparison of the destructive bend strength to the attachment width. The attachment width is the thickness of the carrier element. For example, the attachment width for a core bit is the width of the steel tube to which the abrasive component is bonded. Infiltration bonded carrier elements achieve a destructive bend strength similar to or greater than a destructive bend strength previously achievable only through laser welding. A width normalized destructive bend strength of a composition can be determined by forming a tool having an attachment thickness of 2 mm and measuring the destructive bend strength as described previously. The width normalized destructive bend strength for an infiltration bonded composition is greater than about 800 N/mm$^2$.

TABLE 3

| Attachment Width (Thickness) E (mm) | Brazed | Direct Sintered | Infiltration Bonded |
|---|---|---|---|
| | Destructive Bend Strength (N/mm$^2$) | | |
| 1 | ≥600 | ≥800 | ≥1200 |
| 1.5 | ≥550 | ≥700 | ≥1000 |
| 1.8 | ≥500 | ≥650 | ≥900 |
| 2 | ≥450 | ≥600 | ≥800 |
| 2.5 | ≥450 | N/A | ≥750 |
| 5 | ≥400 | N/A | ≥700 |
| 10 | ≥350 | N/A | ≥600 |

What is claimed is:

1. An abrasive article comprising:

a carrier element having a tensile strength of at least about 600 N/mm$^2$;

an abrasive component, the abrasive component includes abrasive particles, a metal matrix comprising a network of interconnected pores substantially filled with bonding metal; and a bonding region between the abrasive component and the carrier element.

2. The abrasive article of claim 1, wherein the bonding region includes at least about 90 wt % of bonding metal.

3. The abrasive article of claim 1, wherein the abrasive article has a destructive bend strength of at least about 500 N/mm2.

4. The abrasive article of claim 1, wherein the abrasive article is a core bit having a destructive bend strength of at least about 750 N/mm2.

5. The abrasive article of claim 1, wherein the abrasive article is a cutting-off blade having a destructive bend strength of at least about 1400 N/mm2.

6. The abrasive article of claim 1, wherein the abrasive particles are in an amount between about 2 vol % and 50 vol % of the abrasive component.

7. An abrasive article comprising:

a carrier element, the carrier element being substantially compositionally stable at a process temperature;

an abrasive component, the abrasive component includes a network of interconnected pores, the abrasive component including abrasive particles and a metal matrix, the metal matrix being substantially compositionally stable at the process temperature; and a bonding metal, the bonding metal being molten at the process temperature, wherein the bonding metal infiltrates the network of interconnected pores and bonds the abrasive component to the carrier element at the process temperature.

8. The abrasive article of claim 7, wherein the abrasive article has a destructive bend strength of at least about 500 N/mm2.

9. The abrasive article of claim 7, wherein the bonding metal includes a metal selected from the group consisting of copper, a copper-tin bronze a copper-tin-zinc alloy, and any combination thereof.

10. The abrasive article of claim 9, wherein the copper-tin-zinc alloy includes a tin content not greater than about 20% and a zinc content not greater than about 10%.

11. The abrasive article of claim 9, wherein the bonding metal further includes titanium, silver, manganese, phosphorus, aluminum, magnesium, or any combination thereof.

12. The abrasive article of claim 7, wherein the abrasive particles are in an amount between about 2 vol % and 50 vol % of the abrasive component.

13. The abrasive article of claim 7, wherein the bonding metal substantially fills the network of interconnected pores to make a densified abrasive component having a density of at least about 96% dense.

14. The abrasive article of claim 13, wherein an amount of bonding metal within the densified abrasive component is between about 20 wt % and about 45 wt % of the densified abrasive component.

15. An abrasive article comprising:

a carrier element;

an abrasive component, the abrasive component includes abrasive particles bound in a metal matrix, the metal matrix including a network of interconnected pores substantially filled with bonding metal; and a bonding region between the abrasive component and the carrier element, the bonding region comprising the bonding metal, the bonding region being a region distinct from the carrier element and being a separate phase from the carrier element.

16. The abrasive article of claim 15, wherein the bonding region includes at least about 90 wt % of bonding metal.

17. The abrasive article of claim 15, wherein the abrasive article has a destructive bend strength of at least about 500 N/mm2.

18. The abrasive article of claim 15, wherein the metal matrix includes a metal selected from the group consisting of iron, iron alloy, tungsten, cobalt, nickel, chromium, titanium, silver, and any combination thereof.

19. The abrasive article of claim 18, wherein the metal matrix further includes a rare earth element.

20. The abrasive article of claim 18, wherein the metal matrix further includes a wear resistant component.

* * * * *